US007007480B2

(12) United States Patent
Nguyen et al.

(10) Patent No.: US 7,007,480 B2
(45) Date of Patent: Mar. 7, 2006

(54) MULTI-AXIAL PIVOTING COMBUSTOR LINER IN GAS TURBINE ENGINE

(75) Inventors: Ly D. Nguyen, Phoenix, AZ (US); Gregory O. Woodcock, Mesa, AZ (US); Stony Kujala, Tempe, AZ (US)

(73) Assignee: Honeywell International, Inc., Morristown, NJ (US)

( * ) Notice: Subject to any disclaimer, the term of this patent is extended or adjusted under 35 U.S.C. 154(b) by 249 days.

(21) Appl. No.: 10/410,791

(22) Filed: Apr. 9, 2003

(65) Prior Publication Data

US 2004/0200223 A1 Oct. 14, 2004

(51) Int. Cl.
*F02C 1/00* (2006.01)
*F02G 3/00* (2006.01)

(52) U.S. Cl. ..... 60/752; 431/114; 60/748; 60/725; 60/798; 60/799

(58) Field of Classification Search ..... 60/798, 60/799, 796, 800, 752, 758, 760, 748, 725; 431/114

See application file for complete search history.

(56) References Cited

U.S. PATENT DOCUMENTS

| | | | | | |
|---|---|---|---|---|---|
| 2,592,060 | A | | 4/1952 | Oulianoff | |
| 3,911,672 | A | | 10/1975 | Irwin | |
| 3,922,851 | A | | 12/1975 | Irwin | |
| 3,990,231 | A | | 11/1976 | Irwin | |
| 4,129,985 | A | * | 12/1978 | Kajita et al. | 60/39.37 |
| 4,322,945 | A | | 4/1982 | Peterson et al. | |
| 4,429,527 | A | * | 2/1984 | Teets | 60/776 |
| 4,446,693 | A | | 5/1984 | Pidcock et al. | |
| 4,573,315 | A | * | 3/1986 | Stroem | 60/39.37 |
| 4,594,848 | A | * | 6/1986 | Mongia et al. | 60/772 |
| 4,686,823 | A | | 8/1987 | Coburn et al. | |
| 5,172,545 | A | * | 12/1992 | Forestier | 60/800 |
| 5,222,358 | A | * | 6/1993 | Chaput et al. | 60/796 |
| 5,285,632 | A | * | 2/1994 | Halila | 60/796 |
| 5,291,732 | A | * | 3/1994 | Halila | 60/796 |
| 5,333,443 | A | * | 8/1994 | Halila | 60/796 |
| 5,457,954 | A | | 10/1995 | Boyd et al. | |
| 5,911,680 | A | * | 6/1999 | Takeoka | 60/797 |
| 5,921,075 | A | * | 7/1999 | Shimoyama et al. | 60/797 |
| 5,970,716 | A | * | 10/1999 | Forrester et al. | 60/746 |
| 6,212,870 | B1 | * | 4/2001 | Thompson et al. | 60/772 |
| 6,216,442 | B1 | | 4/2001 | Belsom et al. | |
| 6,269,647 | B1 | * | 8/2001 | Thompson et al. | 60/748 |
| 6,279,313 | B1 | * | 8/2001 | Lawen et al. | 60/797 |
| 6,305,172 | B1 | * | 10/2001 | Kim | 60/760 |
| 6,314,739 | B1 | * | 11/2001 | Howell et al. | 60/748 |
| 6,317,865 | B1 | * | 11/2001 | Itoh | 716/11 |
| 6,397,603 | B1 | * | 6/2002 | Edmondson et al. | 60/753 |
| 6,434,821 | B1 | * | 8/2002 | Nelson et al. | 29/888.01 |
| 6,453,675 | B1 | * | 9/2002 | Royle | 60/800 |
| 6,530,227 | B1 | * | 3/2003 | Young et al. | 60/776 |
| 6,715,279 | B1 | * | 4/2004 | White | 60/39.821 |
| 6,775,985 | B1 | * | 8/2004 | Mitchell et al. | 60/772 |

* cited by examiner

*Primary Examiner*—William H. Rodriguez
(74) *Attorney, Agent, or Firm*—Robert Desmond, Esq.

(57) ABSTRACT

A multi-axial pivoting liner within the combustion system of a turbine engine allows the system to work with minimum thermal interference, especially during system operation at transient conditions, by allowing the liner to pivot and slide about its centerline and relative to the turbine scroll. The pivoting liner has the ability to control and minimize air leakage from part to part, for example, from the liner to the turbine scroll and liner to the surrounding structures, during various operating conditions. Additionally, the liner provides for easy assembly with no flow path steps. Finally, the pivoting liner tolerates thermal and mechanical stresses and minimizes thermal wear.

26 Claims, 5 Drawing Sheets

MULTI-AXIAL PIVOTING COMBUSTOR LINER IN GAS TURBINE ENGINE

GOVERNMENT RIGHTS

This invention was made with support from the U.S. Navy under Contract No. N00019-02-C-3002. The Government has certain rights in this invention.

BACKGROUND OF THE INVENTION

The present invention generally relates a combustor liner in a turbine engine, and, more specifically, to a multi-axial pivoting combustor liner that minimizes thermal interference during engine operation. A gas turbine engine includes a compressor that provides pressurized air to a combustor wherein the air is mixed with fuel and burned for generating hot combustion gases. These gases flow downstream to one or more turbines that extract energy therefrom to power the compressor and provide useful work such as powering an aircraft in flight. Combustors used in aircraft engines typically include a combustor liner to protect surrounding engine structure from the intense heat generated by the combustion process.

A conventional can combustor liner has a cylindrical shape with one open end. A thin sheet metal material, capable of withstanding high temperature conditions, is usually used to fabricate the body through a forming process. The liner is often supported on one end or suspended by a few points. The conventional liner assembly and fabrication technique is adequate only for low cycle and low performance engines.

U.S. Pat. No. 3,911,672 discloses a combustor having a ceramic liner. Referring to FIGS. 1 and 2 of the patent, an abutment 22 includes a flange 24 engaging the liner surface of a dome 6 around an opening 7. A slightly yieldable or resilient gasket 25 is disposed between flange 24 and the ceramic liner. This conventional system relies on bolts and screws to make the assembly. The combustor described in the patent does not, however, have multi-axial pivoting capabilities.

U.S. Pat. No. 4,446,693 discloses a cooled wall structure for a gas turbine engine in which the wall is capable of providing a relative movement to cope with the thermal strains experienced by the combustion process. Referring to FIGS. 3, 7 and 8, the wall structure has an inner wall 20 and an outer wall 18. Attachment is provided by a central pin 28a passing through an opening 30 in the outer wall. Central pin 28a is secured to outer wall 18 by welding. Outer pins 28b, on each side of central pin 28a, pass through an opening 32, and a collar 34 is attached to each wall outer pin 28b. Thus, the downstream end of each wall element is securely attached to the outer wall by central pin 28a and is located on the outer wall by outer pins 28b so that the wall element moves to a limited extent with respect to central pin 28a. The wall of this patent is a cooled slidable wall that does not have multi-axial pivoting capabilities, and, more to the point, is not capable of any pivoting motion.

As can be seen, there is a need for an improved combustor liner for gas turbine engines. Such an improved combustor liner must have the ability to control small amounts of air leakage, provide easy assembly, have no flow path steps, and tolerate thermal and mechanical stresses while minimizing thermal wear and fretting for the life of the liner.

SUMMARY OF THE INVENTION

In one aspect of the present invention, a liner for a turbine engine, comprises a lower joint that moveably connects the liner with a combustion gas output receiving device; and an upper joint that movably attaches the liner to the sleeve and combustor cap/housing; with the lower joint and the upper joint providing multiple axes of movement for the liner.

In another aspect of the present invention, a combustor liner for a gas turbine engine comprises a lower joint that moveably connects the liner with a turbine scroll; an upper joint that movably attaches the liner to the sleeve and combustor cap/housing; the lower joint and the upper joint providing multiple axes of movement for the liner; a vibration damper/thermal and mechanical spring; the vibration damper/thermal and mechanical spring providing resiliency to the liner in a first direction from the atomizer to the turbine scroll, thereby maintaining the upper joint in a connected state; the vibration damper/thermal and mechanical spring providing resiliency to the liner in a second direction, orthogonal to the first direction, thereby minimizing movement of the liner in the second direction; a hole in the liner for inserting an igniter; and a grommet for moveably holding the igniter in the hole. More importantly, the mechanical spring provides constant contact during all flight maneuvering conditions and shipment.

In yet another aspect of the present invention, a combustor liner for a gas turbine engine of a high performance aircraft comprises a lower joint that moveably connects the liner with a turbine scroll; an upper joint that movably attaches the liner to the sleeve and combustor cap/housing; the lower joint and the upper joint providing multiple axes of movement for the liner; a vibration damper/thermal and mechanical spring; the vibration damper/thermal and mechanical spring providing resiliency to the liner in a first direction from the atomizer to the turbine scroll, thereby maintaining the upper joint in a connected state; the vibration damper/thermal and mechanical spring providing resiliency to the liner in a second direction, orthogonal to the first direction, thereby minimizing movement of the liner in the second direction; a hole in the liner for inserting an igniter; a grommet for moveably holding the igniter in the hole; a forging ring, the forging ring having a first surface for movably contacting the turbine scroll and a second, opposite surface attached to the liner; the first surface forming a substantially spherical point of contact between the liner and the turbine scroll; the second surface having a diameter smaller than a diameter of the first surface; fine holes in the forging ring; an upper joint louver for deflecting air from the upper joint; dilution holes in the upper joint, the dilution holes providing cooling for the upper joint; and a carbon deflector extending into the combustion zone around the upper joint.

In a further aspect of the present invention, a turbine engine comprises a combustor liner having a lower joint that moveably connects the liner with a combustion gas output receiving device and an upper joint that movably attaches an atomizer to the liner, the lower joint and the upper joint providing multiple axes of movement for the liner.

In still a further aspect of the present invention, a method for operating a turbine engine, comprises encasing a combustor zone with a combustor liner; providing a fuel source to the combustor zone; providing an ignition source to the combustor zone; and passing the combustion gases through a turbine scroll to drive a turbine; wherein the combustor liner is a multi-axial pivoting liner having a lower joint that moveably connects the liner with the turbine scroll and an upper joint that movably attaches the fuel source to the liner, the lower joint and the upper joint providing multiple axes of movement for the liner.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides a multi-axial pivoting liner within the combustion system of a turbine engine. The pivoting liner allows the system to work with minimum thermal interference, especially during system operation at transient conditions, by allowing the liner to pivot and slide about its centerline and relative to the turbine scroll. The pivoting liner should also have the ability to control and minimize air leakage from part to part, for example, from the liner to the turbine scroll, during various operating conditions. Additionally, the liner should also provide for easy assembly with no steps in the combustion gas flow path. Finally, the liner should tolerate thermal and mechanical stresses and minimize thermal wear.

Conventional combustor liners are often supported on one end or suspended by a few points. The conventional liner assembly and fabrication technique is adequate only for low cycle and low performance engines. Thermal and mechanical stresses on a conventional liner in a high performance engine may result in liner damage and/or air leakage. The thermal and mechanical stress on the liner must be minimized to meet a fatigue requirement. In accommodating this fatigue requirement, the liner of the present invention is designed to pivot to wherever the thermal displacement dictates.

Figure 1:
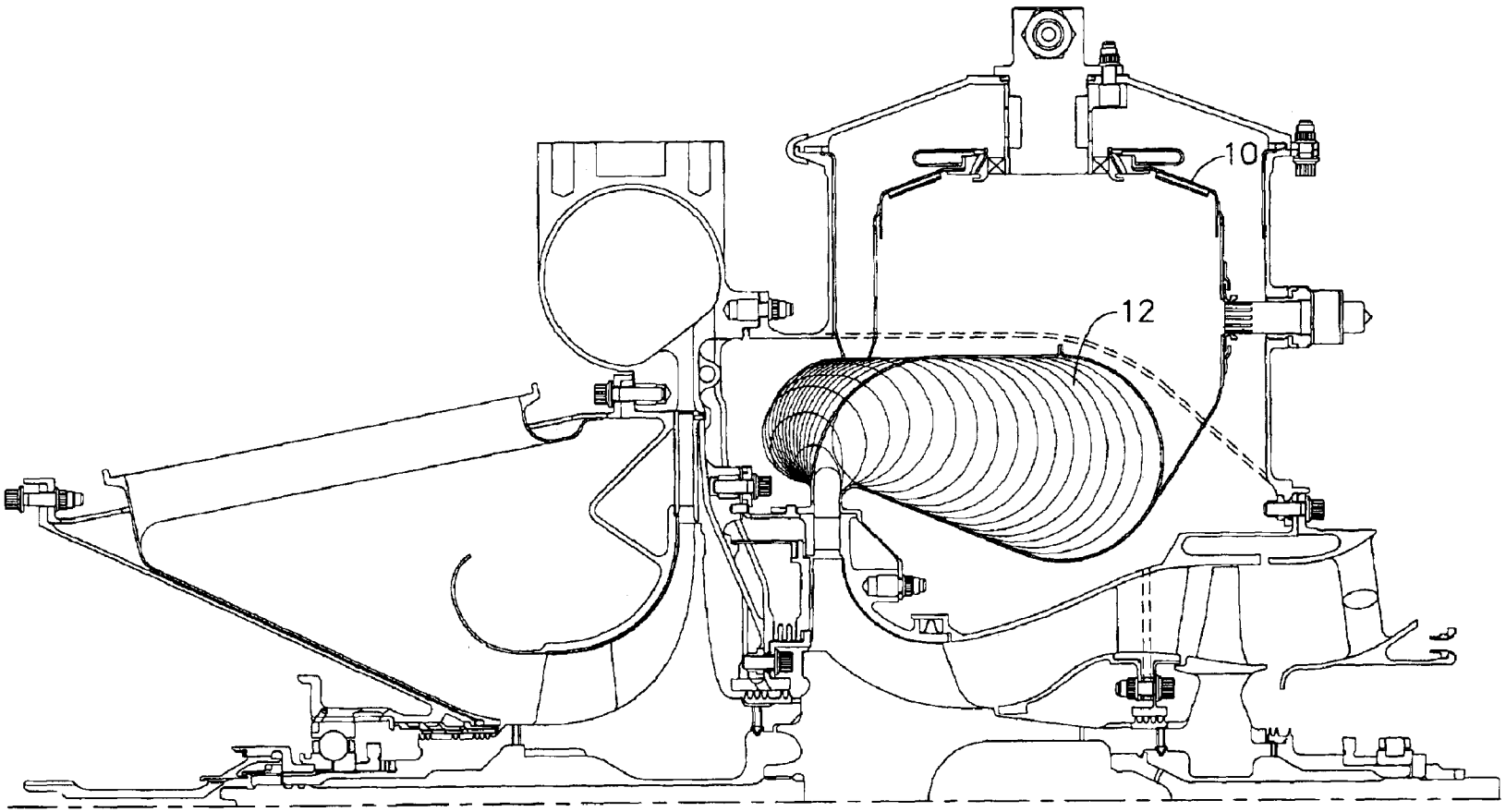
FIG. 1 is a partial cross sectional view of a power section of a turbine engine having a pivoting liner according to the present invention.

Referring to FIG. 1, there is shown a partial cross section view of a power section of a turbine engine having a pivoting liner 10 according to the present invention. Pivoting liner 10 may be attached to turbine scroll 12 which delivers the combustor output gases to drive a turbine.

Figure 2:
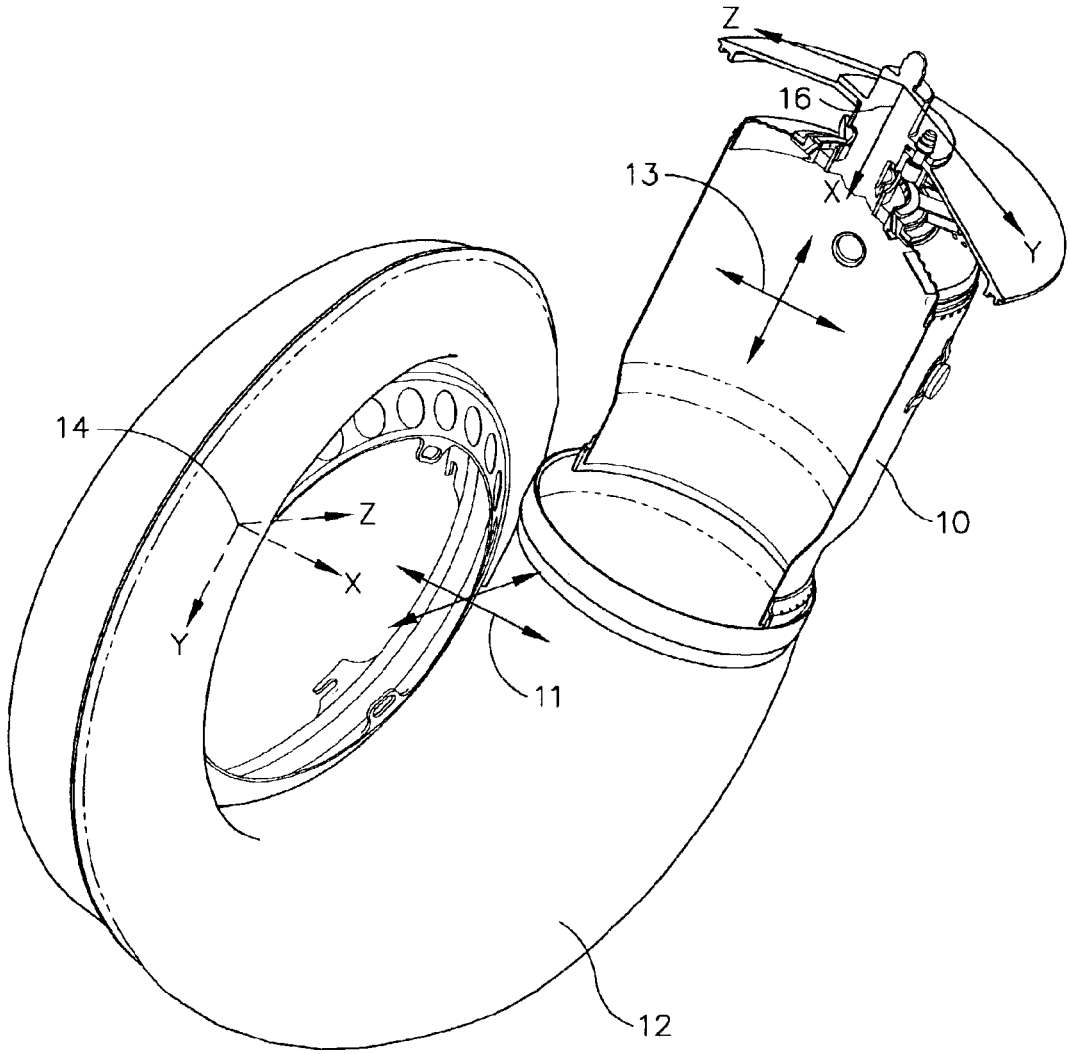
FIG. 2 is a partially cut-away perspective view showing the axes of thermal displacement of the pivoting liner of the present invention and turbine scroll attached to this pivoting liner.

Referring now to FIG. 2, there is shown a partially cut-away perspective view showing the axes of thermal displacement of pivoting liner 10 and turbine scroll 12. During a thermal cycle of the turbine engine, turbine scroll 12 may deflect as shown by scroll coordinates 14, along the engine centerline. At the same time, liner 10 may deflect, as shown by liner coordinates 16, along a liner centerline 68. These two sources of thermal deflection vectors are illustrated by 11 and 13, which includes two different centerlines, may create a high degree of mechanical stress on the liner 10 and turbine scroll 12 of the system. By providing a pivoting liner 10, thermal and mechanical stress on liner 10 and turbine scroll 12 of the system are minimized, allowing the system to meet fatigue cycles requirement.

Figure 3:
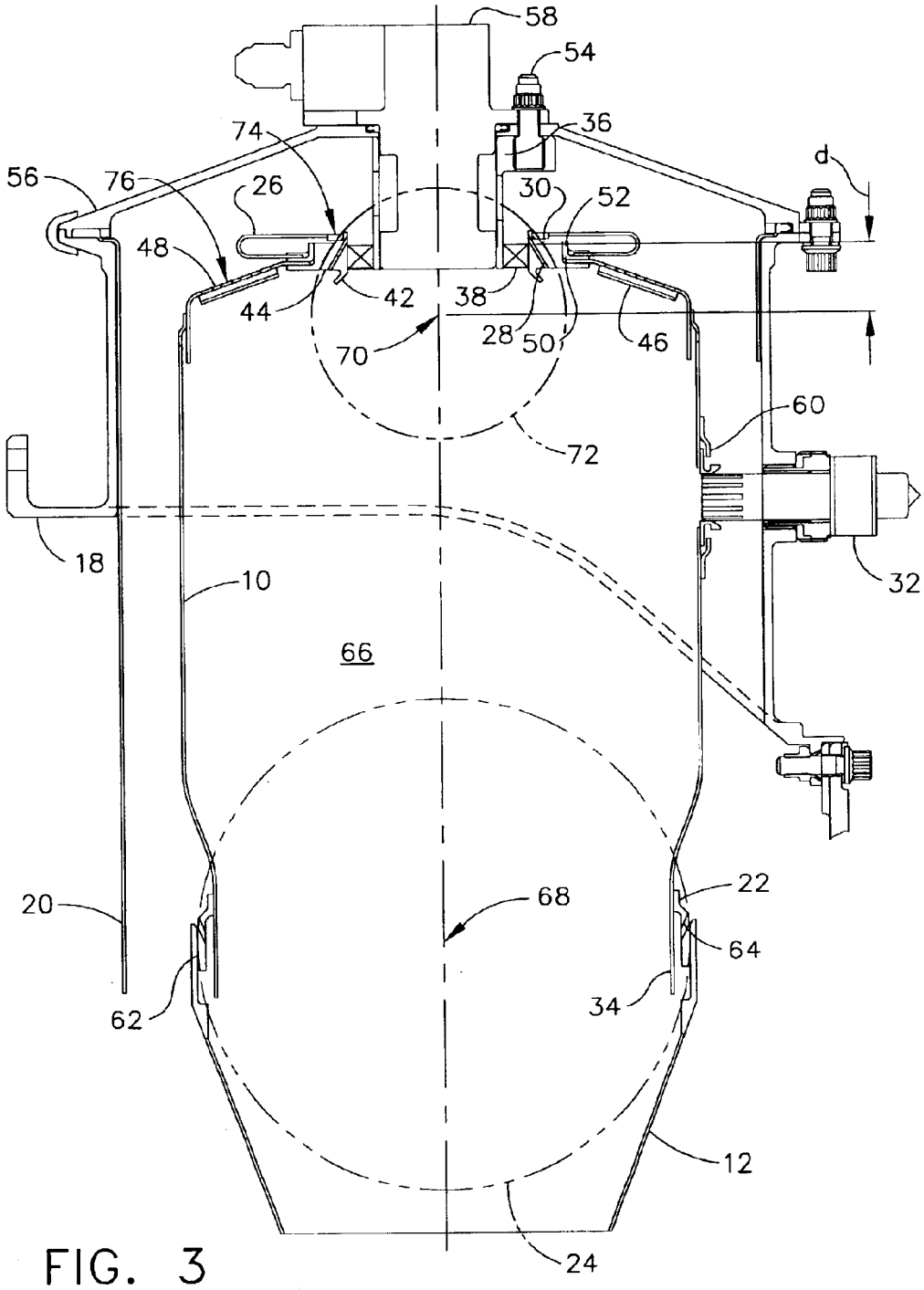
FIG. 3 is a schematic view of multi-axial pivoting liner of the present invention.
Figure 4:
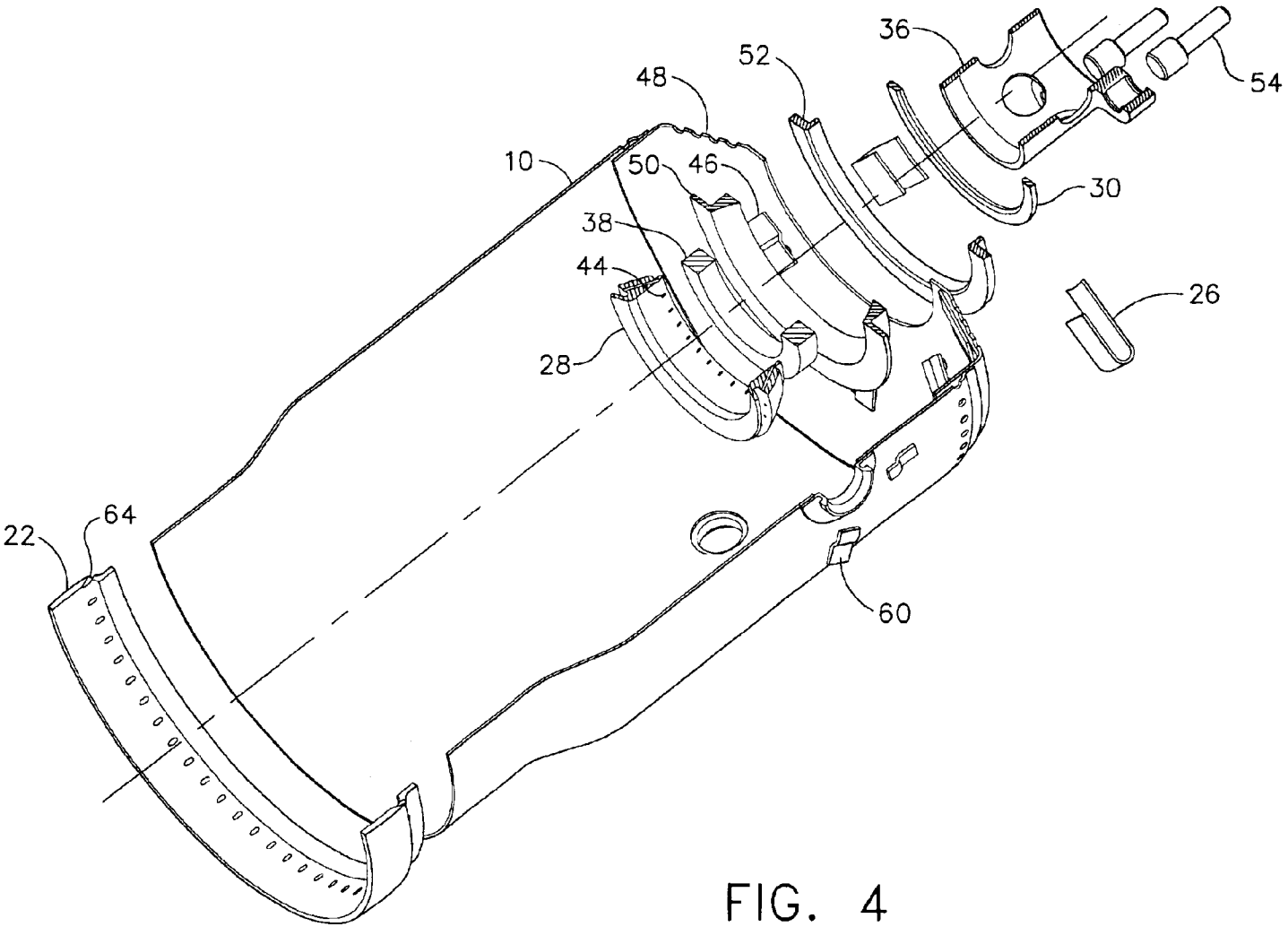
FIG. 4 is a cut-away perspective view showing the assembly of the multi-axial pivoting liner of FIG. 3.
Figure 5:
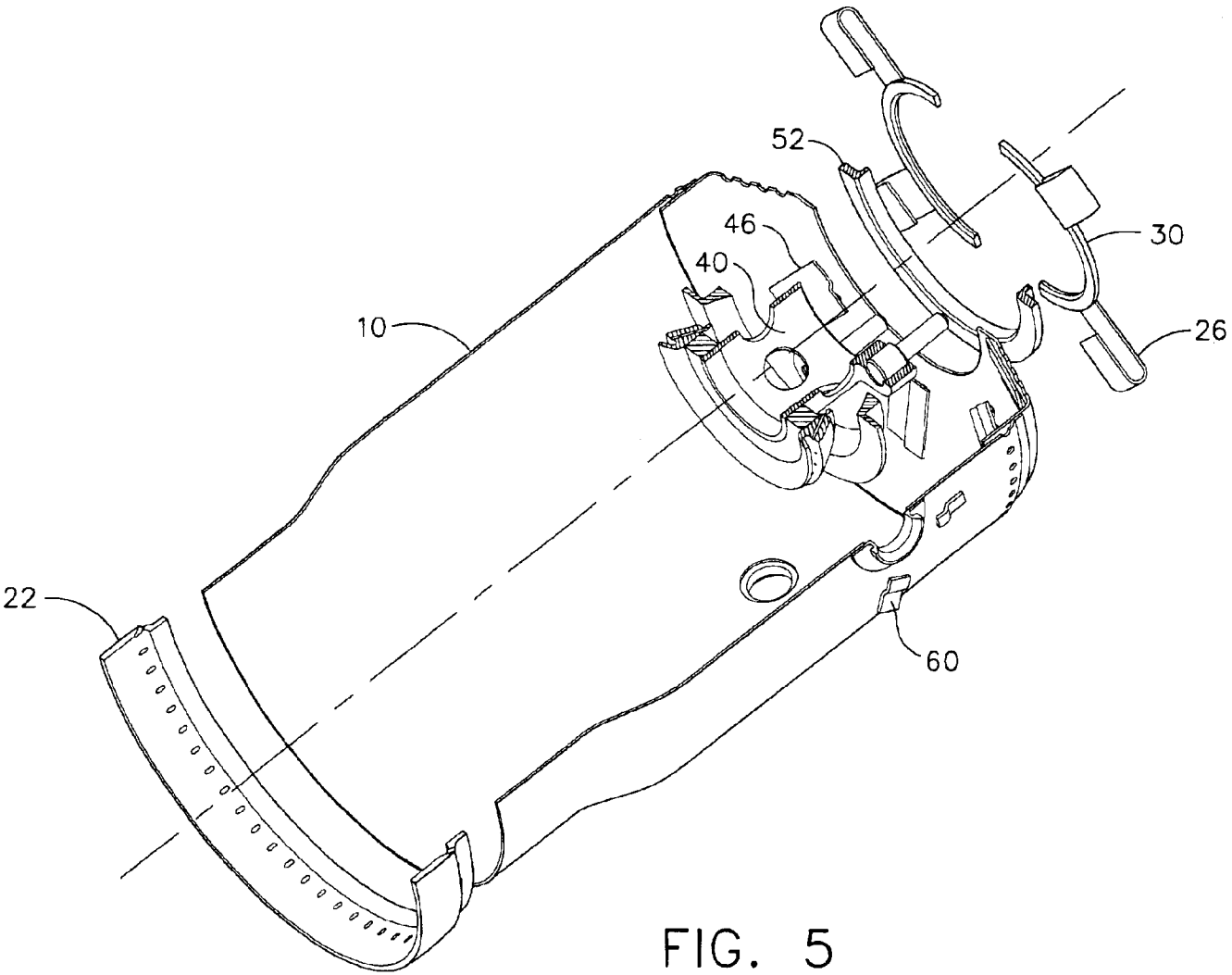
FIG. 5 is a cut-away perspective view showing the assembly of the multi-axial pivoting liner of FIG. 3.

Referring to FIGS. 3 through 5, there are shown partially cut-away schematic views of the assembly of the multi-axial pivoting liner. Liner 10 partially encases a combustor zone 66 of the turbine engine. Liner 10 may be designed to pivot within a combustor housing 18 and an air deflector 20. A lower joint 22 allows liner 10 to contact turbine scroll 12 and revolve with a circular line contact 24 along the spherical surface of forging ring 62. Lower joint 22 may be designed to have a constant spherical circumference that may pivot on its own center, thereby permitting angular and axial motions along the liner centerline 68, maintaining a constant gap between the line 10 and turbine scroll 12, and permitting relative motion along all possible axes. A series of fine holes 64 help maintain uniform temperature between lower joint 22 and turbine scroll 12. The maintenance of a substantially uniform temperature at lower joint 22 assists in controlling the air leakage that contributes the performance efficiency by reducing thermal variations at lower joint 22. A louver 34 may be used to deflect hot gases from lower joint 22, thereby further assisting in the maintenance of uniform temperature of lower joint 22. Louver 34 may also help to provide a cooling film next to the turbine scroll 12 surface and therefore control leakage by maintaining a specific gap between itself and turbine scroll 12. Louver 34 may be formed integral with liner 10. Liner 10 may have a forging ring 62 brazed thereto, providing contact with turbine scroll 12. This double overlap feature provided by lower joint 22 and louver 34 helps prevents the conventionally known hour-glass shaped distortion at the liner 10/turbine scroll 12 joint.

A vibration damper/thermal and mechanical spring 26 may provide a pre-load on an upper joint 28 at all times. This pre-load is especially useful to maintain contact during shipment and flight maneuvers when there may be unusually high g-forces acting on the turbine engine. At the end of vibration damper/thermal and mechanical spring 26 there may be welded to a machined segment 30 to act as a surging stopper by preventing damage to an igniter 32 due to shear force.

Upper joint 28 may be formed by contacting two substantial spherical surfaces, upper inner surface 74 and upper outer surface 50 to minimize leakage, provide wear surface area, and allow angular pivoting motion while constraining motion along liner axial axis. Dimension "d" is the distance from upper joint 28 to an offset center point 70 of a sphere projected diameter 72. Dimension "d" is optimized to provide the appropriate contact angle formed between liner centerline 68 and the surface of upper joint 28 that formed upper inner surface contact 74 and upper outer surface 50. The optimization of dimension "d" is critical to prevent excessive friction force by maximizing the pivoting contact surfaces.

Upper inner surface 74 may be brazed to or integrally formed with a bushing 36 and a swirler 38 to form an inner race 40. Upper inner surface 74 may also include a carbon deflector 42 to reduce or prevent carbon build up in the system. Sweep holes 44 may be provided to cool upper joint 28 and prevent carbon formation. A louver 46 and a series of louver holes 48 may be provided to deflect air and prevent carbon build up in the dome 76. Effusion cooling may be provided as an alternative to prevent carbon formation as well. The outer race includes an upper-outer surface 50 that sandwiches dome 76 within a retainer ring 52. Studs 54 may be used to hold liner 10, via upper joint 28, with a combustor cap 56 together with an atomizer 58. Studs 54 may also maintain the position of liner 10 during the replacement or inspection of atomizer 58. The resulting assembly allows liner 10 to pivot at upper joint 28 and about point 70 while accommodating thermal relative growth between liner 10 and turbine scroll 12, combustor housing 18 and combustor cap 56.

Igniter 32 may use a grommet 60 in liner 10 to prevent igniter 32 from interfering with any movement of the system. This system helps relieve stress on igniter 32 during movement of either liner 10 or turbine scroll 12.

It should be understood, of course, that the foregoing relates to preferred embodiments of the invention and that modifications may be made without departing from the spirit and scope of the invention as set forth in the following claims.

We claim:

1. A liner for a turbine engine, comprising:

a lower joint that movably connects said liner with a combustion gas output receiving device;

an upper joint that movably attaches a housing to said liner, said upper joint formed by contacting two substantially spherical surfaces; and said lower joint providing angular and axial axes of movement for said liner with respect to said combustion gas output receiving device, and said upper joint providing angular axes of movement for said liner with respect to said housing.

2. The liner according to claim 1, wherein said combustion gas output receiving device is a turbine scroll.

3. A liner for a turbine engine, comprising:

a lower joint that movably connects said liner with a turbine scroll;

an upper joint that movably attaches a housing to said liner, said upper joint formed by contacting two substantially spherical surfaces;

said lower joint and said upper joint providing multiple axes of movement for said liner;

a vibration damper/thermal and mechanical spring providing a preload to said upper joint in a first direction along a liner centerline, thereby maintaining said upper and lower joint in a connected state; and said upper joint minimizing movement of said liner in a second direction orthogonal to said first direction, so as to minimize leakage, provide wear surface area, and allow angular pivoting motion while constraining motion along a liner axial axis.

4. The liner according to claim 3, further comprising:

a forging ring, said forging ring having a first surface for movably contacting said turbine scroll and a second, opposite surface attached to said liner;

said first surface forming a substantially spherical point of contact between said liner and said turbine scroll; and said second surface having a diameter smaller than a diameter of said first surface.

5. The liner according to claim 4, further comprising a louver formed from said liner extending toward said turbine scroll past the point of attachment of said second surface and said liner, said louver deflecting hot gases from said lower joint during operation of said turbine engine.

6. The liner according to claim 5, further comprising fine holes in said forging ring.

7. The liner according to claim 3, further comprising an upper joint louver for deflecting air from said upper joint.

8. The liner according to claim 7, further comprising sweep holes in said upper joint, said sweep holes providing cooling for said upper joint and preventing carbon formation at said upper joint.

9. The liner according to claim 3, further comprising a carbon deflector extending into a combustion zone around said upper joint.

10. The liner according to claim 3, wherein a contact angle formed between said liner centerline and said upper joint is optimized to minimize friction force between said two substantially spherical surfaces.

11. A combustor liner for a gas turbine engine comprising:

a lower joint that movably connects said liner with a turbine scroll;

an upper joint formed by contacting two substantially spherical surfaces that movably attach a housing to said liner;

said lower joint and said upper joint providing multiple axes of movement for said liner;

a vibration damper/thermal and mechanical spring;

said vibration damper/thermal and mechanical spring providing a preload to said upper joint in a first direction along a liner centerline, thereby maintaining said upper joint in a connected state;

said upper joint minimizing movement of said liner in a second direction orthogonal to said first direction;

a hole in said liner for inserting an igniter; and a grommet for movably holding said igniter in said hole.

12. The liner according to claim 11, further comprising:

a forging ring, said forging ring having a first surface for movably contacting said turbine scroll and a second, opposite surface attached to said liner;

said first surface forming a substantially spherical circumferential line of contact between said liner and said turbine scroll; and said second surface having a cylindrical diameter smaller than a spherical diameter of said first surface.

13. The liner according to claim 12, further comprising:

fine holes in said forging ring;

an upper joint louver for deflecting air from said upper joint; and sweep holes in said upper joint, said sweep holes providing cooling for said upper joint and preventing carbon formation on said two substantially spherical surfaces.

14. The liner according to claim 13, further comprising a carbon deflector extending into a combustion zone around said upper joint.

15. A combustor liner for a gas turbine engine of a high performance aircraft comprising:

a lower joint that movably connects said liner with a turbine scroll;

an upper joint formed by contacting two substantially spherical surfaces that movably attach a housing to said liner;

said lower joint and said upper joint providing multiple axes of movement for said liner;

a vibration damper/thermal and mechanical spring;

said vibration damper/thermal and mechanical spring providing a preload to said upper joint in a first direction along a liner centerline, thereby maintaining said upper joint in a connected state;

said upper joint minimizing movement of said liner in a second direction-orthogonal to said first direction;

a hole in said liner for inserting an igniter;

a grommet for movably holding said igniter in said hole;

a forging ring, said forging ring having a first surface for movably contacting said turbine scroll and a second, opposite surface attached to said liner;

said first surface forming a substantially circumferential line of contact between said liner and said turbine scroll;

said second surface having a spherical diameter smaller than a cylindrical diameter of said first surface;

fine holes in said forging ring;

an upper joint louver for deflecting air from said upper joint;

sweep holes in said upper joint, said sweep holes providing cooling for said upper joint;

a contact angle formed between a said liner centerline and said upper joint is optimized to minimize friction force between said first surface and said second surface; and a carbon deflector extending into said combustion zone around said upper joint.

16. A turbine engine comprising a combustor liner having a lower joint that movably connects said liner with a forging ring of a combustion gas output receiving device, said liner able to revolve with a circular line contact along a spherical surface of said forging ring and an upper joint having two substantially spherical surfaces that movably attach a housing to said liner, said lower joint providing angular and axial axes of movement for said liner, and said upper joint providing angular axes of movement for said liner.

17. A turbine engine comprising:

a combustor liner having a lower joint that movably connects said liner with a combustion gas output receiving device and an upper joint having two substantially spherical surfaces that movably attach a housing to said liner, said lower joint and said upper joint providing multiple axes of movement for said liner;

an atomizer for injecting fuel into a combustor;

an igniter for igniting said fuel, said igniter movably attached to said liner;

a combustor housing and a combustor cap for encasing at least an upper portion of said combustor liner, said combustor housing and said combustor cap having said atomizer and said igniter mounted therein; and a turbine scroll for receiving combustion gases, said turbine scroll movably attached to said liner.

18. The turbine engine according to claim 17, further comprising:

a vibration damper/thermal and mechanical spring;

said vibration damper/thermal and mechanical spring providing a preload to said upper joint in a first direction from said atomizer to said turbine scroll, thereby maintaining said upper joint in a connected state; and said upper joint minimizing movement of said liner in a second direction orthogonal to said first direction, so as to minimize air leakage from said liner, provide wear surface area, and allow angular pivoting motion of said liner with respect to said housing while constraining the translational motion of said liner with respect to said upper joint along a liner longitudinal axis.

19. The turbine engine according to claim 18, further comprising:

a forging ring, said forging ring having a first surface for movably contacting said turbine scroll and a second, opposite surface attached to said combustor liner;

said first surface forming a substantially spherical circumferential line of contact between said liner and said turbine scroll; and said second surface having a cylindrical diameter smaller than a spherical diameter of said first surface.

20. The turbine engine according to claim 19, further comprising:

a louver formed from said combustor liner extending past the point of attachment of said second surface and said liner, said louver deflecting hot gases from said lower joint during operation of said turbine engine; and fine holes in said forging ring.

21. The turbine engine according to claim 20, further comprising an upper joint louver for deflecting air from said upper joint.

22. The turbine engine according to claim 21, further comprising sweep holes in said upper joint, said sweep holes providing cooling for said upper joint and preventing carbon formation at said upper joint.

23. The turbine engine according to claim 22, further comprising a carbon deflector extending into a combustion zone around said upper joint.

24. A method for operating a turbine engine, comprising:

encasing a combustor zone with a combustor liner;

providing a fuel source via an atomizer to said combustor zone;

providing an ignition source to said combustor zone; and passing combustion gases through a turbine scroll to drive a turbine; wherein:

said combustor liner is a multi-axial pivoting liner having a lower joint that movably connects said liner with said turbine scroll and an upper joint formed by contacting two substantially spherical surfaces that movably attach a housing to said liner, said lower joint providing for angular and axial directions of movement for said liner, and said upper joint providing for angular directions of movement for said liner, wherein inspection or removal of said atomizer is performed without requiring complete disassembly of said combustor liner.

25. A method for operating a turbine engine, comprising:

encasing a combustor zone with a combustor liner;

providing a fuel source via an atomizer to said combustor zone;

providing an ignition source to said combustor zone; and passing combustion gases through a turbine scroll to drive a turbine; wherein said combustor liner is a multi-axial pivoting liner having a lower joint that movably connects said liner with said turbine scroll and an upper joint formed by contacting two substantially spherical surfaces that movably attach a housing to said liner, said lower joint and said upper joint providing multiple axes of movement for said liner, wherein inspection or removal of said atomizer is performed without requiring complete disassembly of said combustor liner;

providing a vibration damper/thermal and mechanical spring at said upper joint;

said vibration damper/thermal and mechanical spring providing a preload to said upper joint in a first direction from said housing, thereby maintaining said upper joint in a connected state;

said upper joint minimizing movement of said liner in said second direction orthogonal to said first direction, so as to minimize leakage, provide wear surface area, and allow angular pivoting motion while constraining motion along a liner axial axis;

movably mounting said igniter to said liner through a grommet;

providing a forging ring, said forging ring having a first surface for movably contacting said turbine scroll and a second, opposite surface attached to said liner;

said first surface forming a substantially spherical point of contact between said liner and said turbine scroll; and said second surface having a diameter smaller than a diameter of said first surface.

26. The method according to claim 25, further comprising:

forming a louver from said liner extending past the point of attachment of said second surface and said liner, said louver deflecting hot gases from said lower joint during operation of said turbine engine;

disposing fine holes through said forging ring;

deflecting air from said upper joint with an upper joint louver; and providing cooling for said upper joint by inserting sweep holes in said upper joint.

* * * * *